US009038553B2

(12) United States Patent
Prufer

(10) Patent No.: US 9,038,553 B2
(45) Date of Patent: May 26, 2015

(54) METHOD AND DEVICE FOR PUNCHING A PLANAR OBJECT USING A SEWING MACHINE

(71) Applicant: BERNINA International AG, Steckborn (CH)

(72) Inventor: Frank Prufer, Hilzingen (DE)

(73) Assignee: BERNINA International AG, Steckborn (CH)

( * ) Notice: Subject to any disclaimer, the term of this patent is extended or adjusted under 35 U.S.C. 154(b) by 11 days.

(21) Appl. No.: 13/873,332

(22) Filed: Apr. 30, 2013

(65) Prior Publication Data

US 2013/0298811 A1 Nov. 14, 2013

(30) Foreign Application Priority Data

May 9, 2012 (CH) ..... 00652/12

(51) Int. Cl.

| | |
|---|---|
| ***D05B 37/00*** | (2006.01) |
| ***D05C 7/04*** | (2006.01) |
| ***D05B 37/04*** | (2006.01) |
| ***D05C 7/02*** | (2006.01) |
| *D05B 81/00* | (2006.01) |

(52) U.S. Cl.

CPC ..... *D05B 81/00* (2013.01); *D05B 37/04* (2013.01); *D05C 7/02* (2013.01); *D05C 7/04* (2013.01)

(58) Field of Classification Search

CPC ..... D05B 37/00; D05B 81/00; D05C 7/04

USPC ..... 112/475.08, 282, 89; 83/684, 685

See application file for complete search history.

(56) References Cited

U.S. PATENT DOCUMENTS

| | | | | |
|---|---|---|---|---|
| 1,984,937 | A | 12/1934 | Livinson et al. | |
| 3,948,194 | A * | 4/1976 | Gunold | 112/131 |
| 4,333,232 | A * | 6/1982 | Orr et al. | 29/767 |
| 4,522,092 | A * | 6/1985 | Dorosz | 83/40 |
| 5,778,806 | A * | 7/1998 | Badillo | 112/68 |
| 6,843,190 | B1 * | 1/2005 | LaPierre-McAfee | 112/475.01 |

FOREIGN PATENT DOCUMENTS

| | | |
|---|---|---|
| DE | 102006036205 | 2/2007 |
| DE | 102008016071 | 10/2009 |
| DE | 102010020623 | 12/2010 |
| EP | 2172585 | 4/2010 |
| EP | 2221409 | 8/2010 |
| JP | 11189965 | 7/1999 |
| JP | 2004089558 | 3/2004 |
| JP | 2007177367 A * | 7/2007 |
| JP | 2010099118 | 5/2010 |

* cited by examiner

*Primary Examiner* — Ismael Izaguirre

(74) *Attorney, Agent, or Firm* — Volpe and Koenig, P.C.

(57) ABSTRACT

A punching device including a punching die (5*a*) that can be connected to the needle bar and a punching matrix (5*b*) that can be fastened to a needle plate (7) of a sewing machine. The punching matrix (5*b*) is embodied as a lid of a clippings container (9). The planar object (23) to be processed is displaced via the tambour frame in a punching plane L2, with this punching plane L2 being arranged parallel above the sewing plane L1.

12 Claims, 1 Drawing Sheet

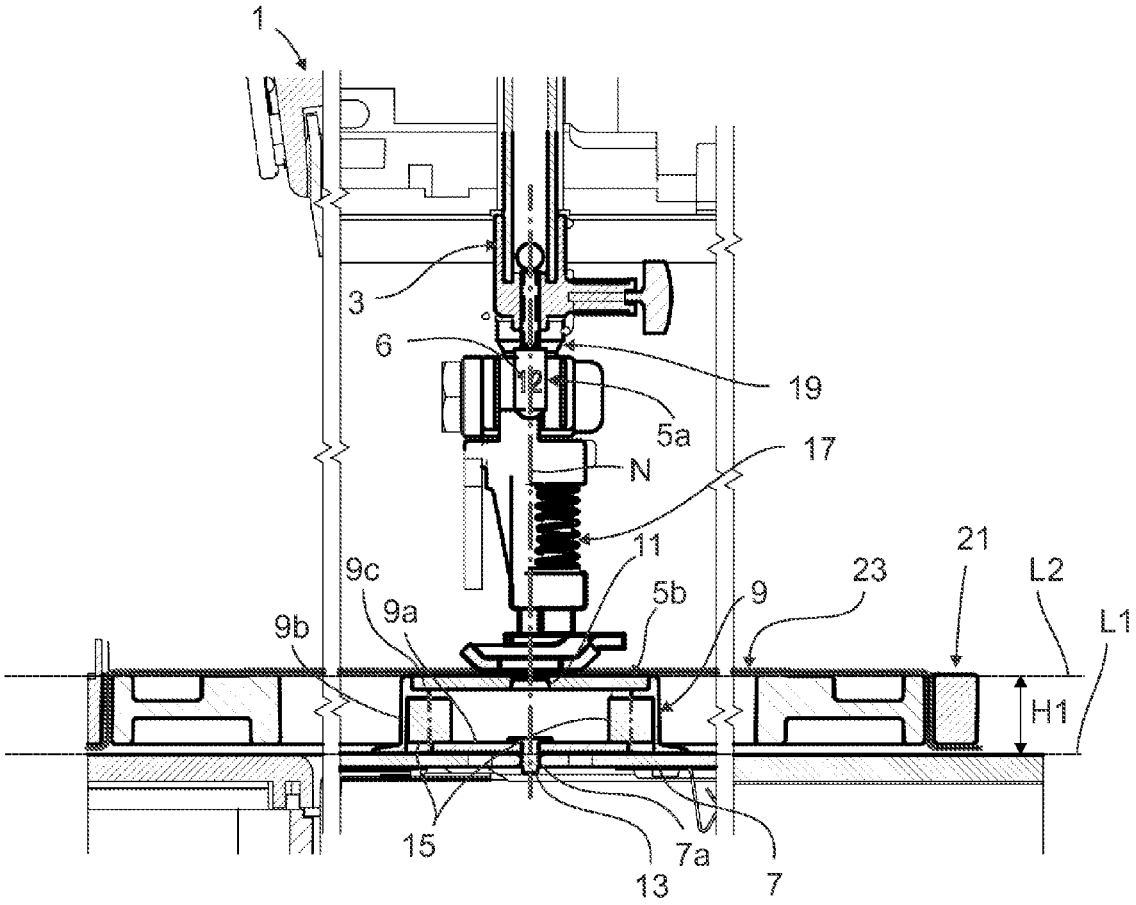
1
3
6
19
5a
N
17
11
9c
9a
9b
5b
9
23
21
L2
L1
H1
15
13
7a
7

METHOD AND DEVICE FOR PUNCHING A PLANAR OBJECT USING A SEWING MACHINE

INCORPORATION BY REFERENCE

The following documents are incorporated herein by reference as if fully set forth: Swiss Patent Application No. 00652/12, filed May 9, 2012.

BACKGROUND

The objective of the invention is a device and a method for punching a planar object using a sewing machine.

Sewing machines generally comprise a stand, from which laterally a lower arm and an upper arm project. The end section of the upper arm is embodied as a machine head, with a needle bar, which can move up and down, and a sewing foot projecting at its bottom. At the lower arm, which serves as a support for the fabric, an exchangeable needle plate is arranged underneath the machine head. It comprises a piercing opening for the sewing needle and recesses for the feed dog of a feeder, which periodically advances the fabric during the sewing process, coordinated with the movement of the needle bar, in a sewing direction perpendicularly in reference to the motion of the needle bar. The feed motion by the feeder can be deactivated in most sewing machines. The motion of the fabric in the sewing plane can alternatively also occur e.g., in a purely manual fashion. Many sewing machines are additionally embodied to connect an embroidery module. Here, the fabric is stretched in a tambour frame, which can be displaced in two orthogonal directions of the sewing plane. When embroidering depending on the predetermined embroidery pattern the tambour frame is displaced into the respectively required position by two independent drives for each of the stitches to be formed.

In an appropriate embodiment, as an alternative to sewing needles, other tools can also be connected to process a planar object connected to the sewing machine. For example, it is known from the European patent application EP2221409A1 to fasten a tool, e.g., a textile pen, via a fastening device to the sewing foot rod of the sewing machine and to use this tool, instead of a sewing needle, to process a textile or non-textile planar object. A fastening device for decorative elements, such as rhinestones or sequins, is known from DE102010020623A1, which can be connected to a sewing machine and influenced by said sewing machine. The decorative elements are stored in magazines or on support tapes and are individually applied by the fastening device on the planar object at the predetermined position. The planar object may for example represent an adhesive transfer film. The decorative elements are first applied in the respective arrangement on the transfer film, where they temporarily are adhered, and they are subsequently transferred via heat to a textile planar object.

Furthermore, EP2172585A1 discloses a rotary device for a cutting needle, which can be fastened at the needle bar. Using this rotary device the alignment of the blade of the cutting needle can be adjusted in reference to the fabric so that the cutting angle can be adjusted to the contours on the planar object to be cut out.

Such devices, which can be connected to the sewing machine, allow processing a planar object with different technologies. When a planar object is stretched in a tambour frame its relative position and alignment at the tambour frame can be maintained for several processing steps. It is also possible to subsequently process several different planar objects in one or more processing steps. Here, the relative coordinates used in reference to the tambour frame can be adjusted to each other for every work piece during processing.

SUMMARY

One objective of the present invention is to provide a punching device for a sewing machine and a method for punching out sections of a planar object. In a punching process generally small sections and/or clippings can be separated entirely from the remainder of the planar object. The punched out clippings may hinder or even prevent any further processing when they remain on the planar object. Another objective of the invention is therefore to embody the punching device such that punched-out parts cannot cause any interference or malfunctions.

These objectives are attained in a device and in a method for punching a planar object with one of more features of the invention.

The punching device comprises a punching die and a punching matrix corresponding to said punching die. Preferably, instead of a sewing needle the punching die is fastened at the needle bar and the punching matrix in the area of the fabric support, preferably directly at the needle plate. The relative positions and, if applicable, alignments of the punching die and the punching matrix are adjusted to each other such that a clear space remains between the punching die and the punching matrix, when the needle bar is in its upper position, and that the punching die when lowering the needle bar is inserted into a recess appropriate for the shape and size of the punching die. Here, in the area of the punching tool clippings are punched out of a work piece and/or planar object to be processed. In order to prevent that they fall onto the planar object and can hinder the further processing of the planar object the punching tool comprises a container for accepting the clippings. This clippings container can be arranged, depending on the embodiment of the punching tool, in the area of the punching matrix or in the area of the punching die. Preferably, the clippings container is embodied like a can and comprises means for fastening at the needle plate in a defined position. The punching matrix with the recess of the punching die can be embodied as a detachable and/or exchangeable lid of the clippings container. Depending on the form and size of the punching die the respectively matching punching matrix can be placed as a lid onto the clippings container.

In an alternative embodiment of the punching tool the punching die is held in the proximity of the needle plate and the punching matrix at the needle bar. Here, the clippings container is arranged adjacent to the punching matrix or the punching die or the punching matrix and/or the punching die form a part of the clippings container.

The planar object to be processed is preferably stretched in a tambour frame or held in a respectively other frame, which can be moved and positioned in two directions of a processing plane, perpendicular in reference to the axis of the needle bar, particularly in a X-Y—plane arranged vertically underneath the needle bar, according to criteria which can be predetermined. The fastening of the planar object at the tambour frame occurs by stretching between an inner frame and an outer frame, with the planar object optionally being stretched over the upper edge of the inner frame or over its bottom edge. A planar object held in a defined position at the tambour frame can be processed in a coordinated fashion in several processing steps using different tools. For example, holes can be punched out of the planar object, showing different sizes and/or shapes. In particular, this way punched grids can be produced, which may be used as sample patterns for rhinestones of identical or different size. The rhinestones are then inserted into the holes of the punched grid. Preferably, patterns are produced, with all of their holes showing the same size as the rhinestones respectively to be accepted, with the hole diameter being slightly and/or a few tenth of a millimeter greater than the maximum diameter of these rhinestones. These patterns are adhered to a planar base, such as a cardboard area. The rhinestones are then applied as bulk goods onto the punched grid prepared in this manner, and moved by way of brushing into the holes of the punched grid. The rhinestones are embodied in an approximately frustum shaped design. During the brushing process only those rhinestones remain in the holes of the punched grid, with their base with the larger diameter being located at the bottom. The other rhinestones are removed from the holes during the brushing process. Subsequently a self-adhesive transfer film is fastened on the top of the rhinestones, so that they can be transferred in the desired arrangement to a textile or other work piece.

As an alternative to punched grids for rhinestones, hole patterns can also be punched out with the punching device from other textile or non-textile planar objects. The coordinates of the individual punched holes of a pattern can be predetermined to the sewing machine and/or generally to the control of the drive of the tambour frame, similar to the coordinates of an embroidery pattern. In particular for fine textiles and/or large-area punched out clippings, prior to punching, these textiles can be adhered e.g. on a detachable support film, so that no or only minimal distortion of the planar object stretched in the tambour frame occurs, which can be tolerated. For the purpose of stabilization as an alternative a non-distorting additional planar object, for example a paper film, can be stretched in the tambour frame together with the textile planar object, here without any adhesion.

If the clippings container is arranged with the punching matrix on the needle plate the processing plane during the punching process is off-set higher by the height equivalent to the clippings container in reference to the sewing plane, which is limited by the support area of the needle plate. Preferably the height of the clippings container is therefore approximately equivalent to the height of the tambour frame. If the planar object is stretched in the tambour frame such, that it is stretched flush with the upper edge and/or flush with the bottom edge of its inner frame, its height position is equivalent to the one of the punching matrix. When moving the tambour frame the planar object is displaced in the punching plane without hindrance. Alternatively the tambour frame may comprise fastening means, by which it can be fastened in two different positions at the drive of the tambour frame such that in one fastening the upper edge of the tambour frame is located type at the top and in the other fastening type at the bottom. Accordingly, the planar object stretched in the tambour frame is located in one fastening type in the plane of the needle plate and/or in the sewing plane and in the other fastening type in the plane of the punching matrix and/or in the punching plane. The mirror-reverse offset of the punching positions caused by flipping the tambour frame can be considered and/or compensated by the control of the drive of the tambour frame such, e.g., that the respective arrangement of the tambour frame is predetermined as a parameter by the control of the drive of the tambour frame. The different assembly types of the tambour frame at the drive of the tambour frame generally result in a transformation of the coordinates of the punching positions. Such transformations cannot only comprise reflections but also off-sets and rotations, which are dependent on the arrangement of the fastening means at the tambour frame. In a memory, which can be accessed by the control, the respective transformation functions can be stored. Depending on the embodiment the control can determine the respective arrangement of the tambour frame at the drive of the tambour frame, for example based on a manually predetermined adjustment value of an input interface of the sewing machine or automatically based on measuring parameters detected by sensors.

The control can then newly calculate the coordinates of the punching positions according to the respective arrangement of the tambour frame at the drive of the tambour frame. Alternatively, in each new arrangement of the tambour frame or the planar object held in the tambour frame the coordinates can be compared anew based on one or more reference points on the planar object. For example, successively three reference points can be made to overlap the insert points of the sewing needle, and the respectively relative or absolute coordinates of the drive of the tambour frame can be detected by the control. By a comparison with target coordinates of the reference points saved earlier the control can calculate the arrangement and alignment of the planar object and accordingly adjust the coordinates of the individual punching points.

This allows processing the work pieces successively with two or more different tools in a coordinated fashion. In particular, e.g., in a textile garment, punching patterns or embroidery patterns can be combined with each other without any offset, with the tambour frame being flipped between these processing steps.

Similar to sewing, during the punching process the planar object is pressed by a sewing foot and/or punching foot against the support and/or held there during processing by the punching tool. If the punching plane is higher than the sewing plane, the punching foot is also embodied appropriately shorter. Similar to sewing, the punching foot also performs a leaping motion during the punching process, in order to allow moving the work piece between the individual punching processes. As an alternative to the separate punching foot fastened at the sewing foot rod an elastic hold-down device that can be fastened at the needle bar, which can accept the function of the punching foot. During the lowering of the needle bar this is then respectively pressed by the spring against the work piece, prior to contacting the punching die, and releases it again after the punching die has been pulled up again. If the resistance of a work piece during punching is so strong that the punching die cannot penetrate the work piece in a single punching cycle the sewing machine may be switched to a hammering mode, in which the punching die presses and/or hammers onto the work piece several times and therebetween is always pulled up partially or entirely. Alternatively, the power supply of the punching die may also be interrupted repeatedly. The number of repetitions may be preselected for example depending on the thickness of the respective work piece. Alternatively, e.g., the position of the needle bar can also be monitored by sensors, and the pulling up of the needle bar can be initiated if the punching die has not entirely penetrated the work piece.

Generally, the blades of punching dies exhibit a round cross-section. For each diameter a matching punching matrix is required with the corresponding diameter. Matching punching dies and punching matrices are preferably provided with identical markers.

If the blade of the punching die is not rotationally symmetrical, means may be provided to predetermine a clear alignment of the punching die and the punching matrix. For example, the punching die may be fastened via a rotary device at the needle bar and can be brought into one of several predetermined angular positions of rotation. Such a rotary device is disclosed for example in EP 2172585. Similarly, a rotary device can also be provided for the punching matrix. For example, the base element and/or the bottom of the clippings container may be fastened at the needle plate in a defined alignment. The lid with the punching matrix can be brought into the same predetermined angular position of rotation in reference to the base element as the punching die. Here, the display means indicating the rotary positions must show the same value at the punching die and at the punching matrix.

In alternative embodiments the punching die may also be fastened at the needle bar in the area of the needle plate and the punching matrix at the needle bar. In order to accept punched-out clippings a clippings container is embodied at the punching matrix or the punching die.

BRIEF DESCRIPTION OF THE DRAWINGS

In the following an exemplary embodiment of the invention is described in greater detail based on a FIGURE. The FIGURE shows a cross-section of a sewing machine with a punching device in the area of the needle bar.

DETAILED DESCRIPTION OF THE PREFERRED EMBODIMENTS

A needle bar 3 projects at the bottom of a sewing machine head 1, with a punching die 5*a* being fastened instead of a sewing needle. The lower part of the punching die 5*a* is rotationally symmetrical and shows a circular cross-section. Its exterior diameter ranges preferably from 0.5 mm to 8 mm. A marking, for example an etched number 6 or a color code, marks the punching die 5*a* in an unambiguous fashion. In particular, identical markings can be applied to a punching die 5*a* and the corresponding punching matrix 5*b*. In punching tools used for the production of punching grids and/or matrices for rhinestones the markings are preferably equivalent to the size statements of the corresponding rhinestones.

A punching matrix 5*b* adjusted to this punching die 5*a* is fastened at the needle plate 8 of the sewing machine underneath the needle bar 3. The punching matrix 5*b* is embodied as an interchangeable or exchangeable lid of a can-like clippings container 9 and shows an inlet opening 11 corresponding in size and shape to the punching die 5*a*. In the example of the punching device shown the diameter of the inlet opening 11 is equivalent to the inlet opening of essentially every of the punching die 5*a* plus a slight play in the range of tenth of millimeters. Towards the bottom the diameter of the inlet opening 11 may widen slightly in a conical fashion, so that punched out clippings of a work piece can easily fall into the clippings container 9 and are not jammed during the punching process. The planar top of the punching matrix 5*a* is arranged at a distance H1 parallel in reference to the top of the needle plate 7 and thus defines a punching plane L2 aligned parallel in reference to the sewing plane L1. At the bottom 9*a* of the clippings container 9 at least one fastening pin 13 projects downwards, which preferably can be inserted into a corresponding recess 7*a* at the needle plate 7 in a form-fitting fashion or with slight play. In the embodiment shown in the FIGURE the needle plate 7 shows a round insert opening for a sewing needle, which is used for inserting the fastening pin 13. The fastening pin 13 and the insert opening 11 in the punching matrix 5*b* are positioned directly opposite each other so that after the placement of the clippings container 9 onto the needle plate 7 it is arranged coaxial in reference to the axis of the needle bar N. In round punching dies 5*a* this is already sufficient, due to the rotational symmetry, for aligning the punching matrix 5*b* in reference to the punching die 5*a*. However, if the punching tool is not rotationally symmetrical the punching die 5*a* and the punching matrix 5*b* must additionally be aligned in a defined relative position of rotation in reference to each other. Instead of a single round fastening pin 13, for this purpose, for example several fastening pins 13 and/or at least one non-rotationally symmetrical fastening pin 13 may project downwards from the bottom 9*a*. When this or these fastening pin(s) 13 is/are engaging respective recesses 7*a* at the needle plate 7 the bottom 9*a* and/or the base element are positioned and aligned in a defined position in reference to the needle plate 7. In additional to the fastening means in the form of fastening pins 13, which allow a positioning and alignment of the base element in reference to the needle plate 7, the clippings container 9 may also comprise a fastening element for detachable fastening to the needle plate 7. In particular, magnets 15 may be embodied at the bottom 9*a* for creating a force-fitting connection with the needle plate 7. The container lid with the punching matrix 5*b* can be placed upon the base element in at least one defined alignment. If the base element, which comprises the floor 9*a* and the side wall 9*b* and/or the side walls 9*b*, exhibits an essentially square cross-section the container lid and/or the punching matrix 5*b* can be placed onto the base element in four defined alignments. Preferably the cross-section of the base element is essentially circular, and the punching matrix 5*b* can be placed upon the base element in various alignments. In order to predetermine one or more different alignments of the punching matrix 5*b* in reference to the base element these parts may comprise respective alignment elements (not shown). In particular the base element and the punching matrix 5*b* may exhibit a gearing or coding, for example in the opposite contact area, which allows the assembly of these parts only in a single or alternatively in several predetermined alignments (not shown). It is particularly advantageous to embody the punching matrix 5*b* as a round plate which exhibits along its periphery at the bottom evenly distributed recesses, bores, or projecting structures (not shown). At an annular step 9*c*, which projects radially inwardly slightly below the upper brim of the side wall 9*b*, and onto which the punching matrix 5*b* is placed, complementary projecting or recessed structures are formed. Preferably the size and arrangement of the magnets 15, which are used for fastening the base element at the needle plate 7, are fastened such that they can also be used for fastening the punching matrix 5*b* at the base element if it is also made from a ferromagnetic material, such as steel. The punching matrix 5*b* is marked with a marking, similar to the punching die 5*b* equivalent to the one of the corresponding punching die 5*a*. If the punching die is not rotationally symmetrical it must be fastened in a defined alignment at the needle bar 3. Preferably this occurs via a rotary device that can be fastened at the needle bar, as described in EP2172585A1. Here, codes and/or indexing elements are provided, which clearly indicate the respective angular position of rotation. Similarly, codes and/or indexing elements may also be provided in the clippings container 9, which unambiguously indicate the respective angular position of rotation of the punching matrix 5*b* in reference to the bottom 9*a* and/or the base element. For this purpose, the punching matrix 5*b* may exhibit an arrow mark in the edge region, for example, which points to a respective marking at the side wall 9*c* in the respective rotary position (not shown). Prior to starting the punching process the arrow mark must be aligned to each marking corresponding to the marking on the rotary device for the punching die 5*a*.

Instead of a sewing foot, here a punching foot 17 adjusted to the elevated punching plane L2 is fastened at the sewing foot rod 19. During the punching process, the punching foot presses the work piece and/or the planar object 23 to be processed against the punching matrix 5*b* and subsequently releases it.

The work piece and/or the planar object 23 can be stretched in a tambour frame 21, namely such that it is not resting in the sewing plane L1 on the needle plate 7 but in the punching plane L2 on the punching matrix 5*b*. This may be achieved, for example, in the stitching frame 21 being connected via an adapter to the drive of the tambour frame, with this adapter lifting the tambour frame 21 by the height H1 of the clippings container 9 (not shown). However, preferably the height H1 of the clippings container 9 is fixed such that it is precisely equivalent to the height of the tambour frame 21. In order to punch the planar object 23, said planar object 23 may be stretched in the tambour frame 21 such that it rests on the punching matrix 5*b* in the punching plane L2. Alternatively the tambour frame 21 may also be turned such that the already stretched planar object 23 is now positioned in the punching plane L2. The arrangement of the tambour frame 21 at the drive of the tambour frame can be communicated to the control of the tambour frame (not shown) cooperating with the control of the sewing machine, for example manually via an input interface or automatically via respective sensors (not shown).

The invention claimed is:

1. A device for punching a planar object (23) using a sewing machine, the planar object (23) being displaceable between a sewing machine head (1) and a needle plate (7) perpendicular in reference to an axis N of a needle bar, the device comprising a punching tool with a punching matrix (5*b*) and a punching die (5*a*) adjusted to the punching matrix (5*b*) in shape and size that is connectable to the sewing machine, with at least one of the punching die (5*a*) or the punching matrix (5*b*) being fastened to the needle bar and moveable relatively between a base position and an end position, with in the base position a clear space being formed between the punching die (5*a*) and the punching matrix (5*b*) in which the planar object (23) is displaceable and positioned for a punching process, so that during motion from the base position into the end position clippings can be punched out of the planar object (23), and the punching tool comprises a clippings container (9) for accepting the punched-out clippings.

2. A device according to claim 1, wherein the punching matrix (5*b*) comprises a contact plate with an inlet opening (11) for the punching die (5*a*) and the contact plate is a part of the clippings container (9) or provided adjacent to said clippings container (9).

3. A device according to claim 2, wherein the contact plate is provided as at least one of a detachable or exchangeable lid of the clippings container (9).

4. A device according to claim 3, wherein the clippings container (9) is can-shaped and comprises a base element with a bottom (9*a*) and a side wall (9*b*), and underneath an upper brim of the side wall (9*b*) an annular shoulder (9*c*) projects inwardly from the side wall (9*b*), and the contact plate is locateable upon the shoulder (9*c*) and is supported in at least one predetermined position or rotation.

5. A device according to claim 2, wherein the clippings container (9) comprises a fastening element for positioning and for a detachable fastening to the needle plate (7) of the sewing machine.

6. A device according to claim 5, wherein the fastening element comprises at least one fastening pin (13), which projects from a bottom of the clippings container (9) and is insertable into a corresponding opening (7*a*) in the needle plate (7).

7. A device according to claim 6, wherein the at least one fastening pin (13) is insertable in a form-fitting fashion or with only minimal play into a stitching hole for the sewing needle in the needle plate (7), and the holding pin (13) and the entry opening (11) of the punching die (5*a*) are arranged coaxial or have a common axis of symmetry.

8. A device according to claim 6, wherein the at least one fastening pin (13) is not embodied rotationally symmetrical or that several of the fastening pins (13) project from the bottom of the clippings container (9) such that by a form-fitting engagement of the fastening pin or pins (13) a torque-proof fastening of the clippings container (9) or at least the base element is provided to the needle plate (7).

9. A device according to claim 5, wherein the fastening element comprises at least one magnet (15) for holding the clippings container to the needle plate (7).

10. A device according to claim 9, wherein the at least one magnet (15) is arranged on the base element of the container (9) for fastening to the needle plate (7), the at least one magnet (15) is also embodied to fasten the contact plate to the base element.

11. A method for punching a planar object with a sewing machine, the planar object (23) being displaceable between a sewing machine head (1) and a needle plate (7) perpendicular in reference to an axis N of a needle bar, the device comprising a punching tool with a punching matrix (5*b*) and a punching die (5*a*) adjusted to the punching matrix (5*b*) in shape and size that is connectable to the sewing machine, with at least one of the punching die (5*a*) or the punching matrix (5*b*) being moveable relatively between a base position and an end position, with in the base position a clear space being formed between the punching die (5*a*) and the punching matrix (5*b*) in which the planar object (23) is displaceable and positioned for a punching process, so that during motion from the base position into the end position clippings can be punched out of the planar object (23), and the punching tool comprises a clippings container (9) for accepting the punched-out clippings, the method comprising: fastening the clippings container (9) via a fastening element to the needle plate (7), stretching the planar object on a tambour frame and connecting the tambour frame to a tambour frame drive, which is connected to the sewing machine such that the planar object is arranged in a punching plane L2, arranged parallel in reference to the sewing plane L1, above the needle plate, and moving the tambour frame such that it successively approaches processing positions, and at the processing positions, punching out parts of the planar object with the punching tool, and the punched out parts are received by the clippings container (9).

12. A method according to claim 11, wherein the punching process is repeatedly performed at a single one of the processing positions if the part cannot be punched out in a single punching step.

* * * * *